United States Patent [19]

Lathrop

[11] 4,374,606

[45] Feb. 22, 1983

[54] DIELECTRIC PLUG FOR A COAXIAL CONNECTOR

[75] Inventor: John C. Lathrop, Harrisburg, Pa.

[73] Assignee: AMP Incorporated, Harrisburg, Pa.

[21] Appl. No.: 210,693

[22] Filed: Nov. 26, 1980

[51] Int. Cl.[3] ..... H01R 13/40

[52] U.S. Cl. ..... 339/177 R

[58] Field of Search ..... 339/59-61, 339/177 R, 177 E, 217 R

[56] References Cited

U.S. PATENT DOCUMENTS

| | | | |
|---|---|---|---|
| 2,356,053 | 8/1944 | Hastings et al. | 339/177 E X |
| 3,323,083 | 5/1967 | Ziegler, Jr. | 333/97 |
| 3,349,166 | 10/1967 | Ziegler, Jr. | 174/88 |
| 3,437,960 | 4/1969 | Ziegler, Jr. | 333/97 |
| 3,460,072 | 8/1969 | Ziegler, Jr. | 333/33 |
| 3,492,605 | 1/1970 | Ziegler, Jr. | 333/33 |
| 3,559,112 | 1/1971 | Ziegler, Jr. | 333/33 |
| 3,678,447 | 8/1972 | Ziegler, Jr. | 339/177 E |

FOREIGN PATENT DOCUMENTS

| | | | |
|---|---|---|---|
| 2745887 | 4/1978 | Fed. Rep. of Germany | 339/177 R |

*Primary Examiner*—Joseph H. McGlynn
*Attorney, Agent, or Firm*—Adrian J. LaRue

[57] ABSTRACT

A dielectric plug is disclosed for coaxial connectors, the plug having an axial bore extending therethrough, and comprising rearward disposed inner and outer concentric cylindrical portions, which are integrally joined to a forward tubular portion. The inner and outer cylindrical portions are radially spaced apart for impedance matching purposes. The radial spacing further provides the outer cylinder with a spring resiliency to facilitate press fit retention of the dielectric plug within a conductive connector shell. The inner concentric portion is likewise provided with resilient spring properties due to the radial spacing, to facilitate resilient receipt of a center contact therein. An outer flange at the rearward end of the dielectric plug is adapted for retaining the dielectric plug within a tubular spring element, as part of the coaxial connector assembly.

3 Claims, 2 Drawing Figures

DIELECTRIC PLUG FOR A COAXIAL CONNECTOR

BACKGROUND OF THE INVENTION

1. The Field of the Invention

The present invention relates to coaxial connectors for terminating coaxial cable. Specifically, the present invention relates to dielectric plugs for such connectors, and the components of the connector assembly which incorporate the dielectric plugs.

2. The Prior Art

Available coaxial connectors generally comprise an outer shell body which is electrically connected to the outer conductor of a coaxial cable, and an inner center contact which electrically terminates the center conductor of the cable. Typically, the center contact is separated and electrically isolated from the outer connector shell by a dielectric plug which is press inserted into the connector shell body. Accordingly, the dielectric plugs for such assemblies must be sufficiently resilient to facilitate a press insertion and retention within the connector shell, and to further facilitate receipt and retention of the center contact within the dielectric plug axial bore. An example of presently available dielectric plug structure is set forth in U.S. Pat. No. 3,678,447, which therein discloses a dielectric plug which is intended for press insertion into an outer connector shell. The dielectric plug also receives a center contact therethrough, with the center contact having an annular skirt which bites into the dielectric plug to thereby retain the center contact in place. While this approach has been accepted by the industry, the interference engagement between the dielectric plug and the connector shell, coupled with the press insertion of the center contact into the dielectric plug has been found to result in damage to components during assembly due to high insertion forces. Specifically, presently structured dielectric plugs do not provide a sufficient resiliency to facilitate their press insertion into connector shells, and consequently structural damage to the plug components often results. Also, present dielectric plugs do not provide a sufficient resiliency to facilitate receipt of the center contact therethrough, without damaging either the contact or plug structure.

Because in terminating coaxial cable, existing connector configurations introduce abrupt diametric changes to one or both cable conductors, an impedance mismatch between the termination and the characteristic impedance of the cable results. Many connector designs attempt to compensate for this mismatch in a variety of fashions. One typical way of compensating is to provide an air dielectric within the connector body. It is therefore desirable for connector plugs or jacks to provide means for compensating for the impedance mismatch introduced by the cable termination.

SUMMARY OF THE PRESENT INVENTION

The present invention relates to a dielectric plug for coaxial connectors. The dielectric plug is configured having an axial bore therethrough, and comprises rearward disposed inner and outer concentric cylinder portions which are integrally joined at forward ends to a forward tubular portion. The inner and outer cylinders are spaced apart radially, and the air gap therebetween provides the means for impedance matching the termination. The air gap between the cylinders also provides the cylinders with a sufficient resiliency, such that the outer cylinder resiliently facilitates press insertion of the dielectric plug into the connector shell, and the inner cylinder resiliently facilitates receipt of a center contact in the axial bore thereof. The resilient characteristics of the concentric cylinder portions therefore permits assembly of a coaxial connector without resulting in structural damage to any connector component.

Accordingly it is an object of the present invention to provide a dielectric plug having means to facilitate resilient press insertion of the plug into a coaxial connector shell.

It is a further object of the present invention to provide a dielectric plug structured having improved means for achieving impedance matching in the cable termination.

Still a further object of the present invention is to provide a dielectric plug structured having improved means to facilitate resilient retention of a contact body therein.

Another object of the present invention is to provide a dielectric plug structured to simultaneously facilitate press fit insertion of the plug structure into an outer connector shell, axial insertion of a contact member into the dielectric plug, and impedance matching means for compensating for impedance mismatch caused by the cable termination.

Yet a further object of the present invention is to provide a dielectric plug structure for coaxial connectors, which is economically and readily produced.

These and other objects which will be apparent to one skilled in the art are achieved by a preferred embodiment which is described in detail below and illustrated by the accompanying drawing.

BRIEF DESCRIPTION OF THE ACCOMPANYING DRAWING

DETAILED DESCRIPTION OF THE PREFERRED EMBODIMENT

Figure 1:
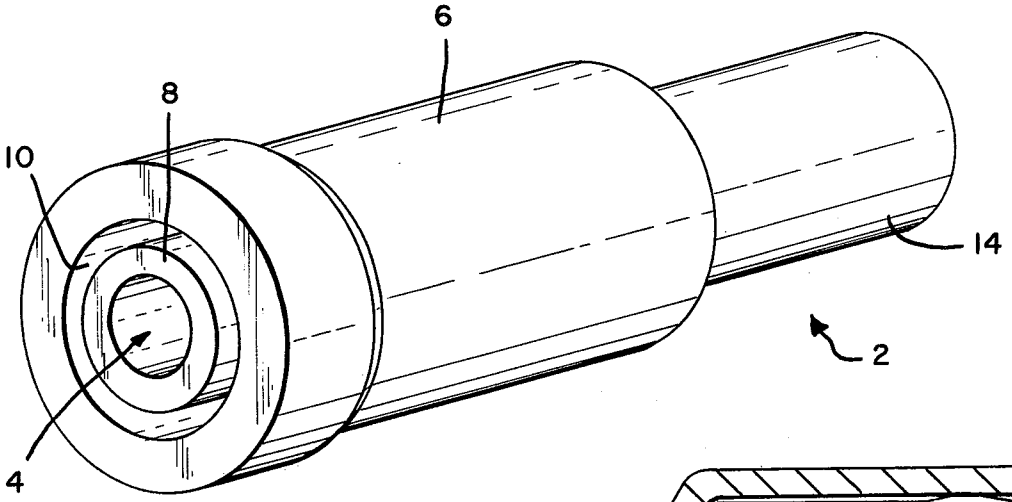
FIG. 1 is a perspective view of the subject dielectric plug structure.

Referring to FIG. 1, the subject dielectric plug comprises a unitary body 2 of dielectric plastics material, tubularly structured having an axial bore 4 extending therethrough. The body comprises outer, rearwardly located, cylindrical portion 6 and inner cylindrical portion 8 positioned concentrically of the outer portion 6. As shown best by FIG. 2, the inner cylindrical portion 8 provides an annular projection 9, located intermediate the ends thereof, which projects into the bore 4.

It will readily be noticed that an air gap 10 is provided between the cylindrical outer and inner portions 6, 8, which provides an air dielectric for impedance matching compensation. Moreover, the presence of the air gap 10 provides cylindrical portions 6, 8, with spring characteristics. Such characteristics are critical to enable the dielectric plug to achieve its additional retention functions.

Continuing, the outer cylinder portion 6 is adapted to provide an outwardly directed annular flange 12 at the rearward end thereof. It will be apparent that the inner and outer cylindrical portions 6, 8, are integrally joined at their forward ends to a forward tubular portion 14.

Figure 2:
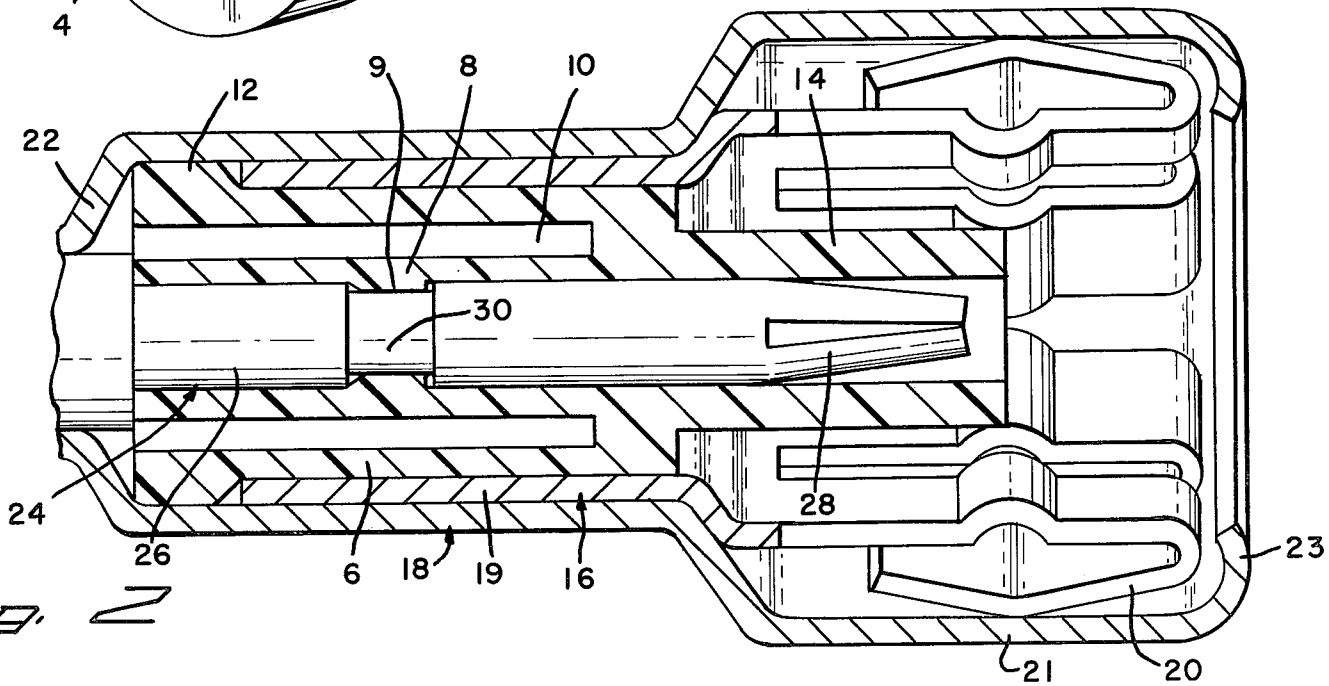
FIG. 2 is a longitudinal section view through an assembled coaxial connector plug, having the subject dielectric plug structure incorporated therein as a component part.

Thus, the axial bore 4 continuously extends through the inner cylindrical portion 8 and the forward tubular portion 14. The subject dielectric body 2 is intended for press insertion within a tubular spring body 16, and is subsequently assembled within an outer coaxial connector shell 18. The dielectric body 2 is seated within a rearward sleeve 19 of the spring body 16. The spring body 16 further includes a plurality of forward projecting spring fingers 20, which are seated within a forward enlarged shell portion 21 of the connector shell 18. The rearward end of the sleeve 19 abuts the external annular flange 12 of the dielectric body, which in turn abuts a contoured shoulder 22 of the outer connector shell 18. Rearward movement of the spring body 16 and the dielectric body 2, is thereby dependently restricted. From FIG. 2, it will be seen that a forward end portion 23 is rolled over forward ends of the spring fingers 20, to protect the spring fingers and to prevent forward movement of the spring body 16 from the connector shell 18. The coaxial connector of FIG. 2 is of the type disclosed in U.S. patent application Ser. No. 210,694 filed Nov. 26, 1980.

Proceeding, with continued reference to FIG. 2, an elongated center contact 24 is provided for terminating the center conductor of the coaxial cable. The center contact 24 comprises a rearward barrel portion 26 which is attached to a forward end of the center conductor by means of a crimp connection. The center contact 24 further includes a forward female receptacle portion 28, and an intermediate annular recess 30 which is axially located between portions 24, and 28. The center contact 24 is affixed to the forward end of the center conductor of the cable, and is subsequently inserted into the inner cylindrical portion 8 of the dielectric body 2, subsequent to the pre-assembly of the dielectric body 2, spring body 16, and connector shell 18. The inner cylindrical portion 8 resiliently accepts insertion of the center contact 24 therein, without necessitating an unduly high insertion force. Also, upon insertion of the contact within the inner cylindrical portion 8, the annular projection of the portion 8 resiliently snaps into the annular recess 30 of the center contact 24, to resiliently retain the contact in position within the bore.

Thus, it will be appreciated that the structure of the subject dielectric body facilitates press insertion of the dielectric body into the outer connector shell 18. The outer cylindrical portion 6 resiliently, and compliantly accommodates the intended press insertion. Further, the structure of the subject dielectric body 2 is such that the inner cylindrical portion 8 is likewise provided with a sufficient resiliency to accommodate press insertion of the center contact 24 therein, and to facilitate resilient retention of the contact subsequent to its insertion. Still further, the air gap between the inner and outer cylindrical portions 6, 8, provides an air dielectric for compensating for impedance mismatch caused by the cable termination.

It is to be understood that the above described preferred embodiment of the present invention is merely illustrative. Other embodiments, which will become apparent to one skilled in the art, and which utilize the teachings herein set forth, are intended to be within the scope and spirit of the subject invention.

What is claimed is:

1. A dielectric plug of resilient material for press insertion into a connector shell body of a coaxial connector and for engaging a center contact means, comprising:

a tubular forward portion;

a tubular rear portion including an inner portion and an outer portion having forward ends integrally joined to said forward portion and being coaxially spaced from one another by an air gap therealong, said inner portion and said forward portion having a continuous axial bore extending therethrough;

said outer portion resiliently exerting radial spring retention force on the shell body after insertion of the dielectric plug therein;

said inner portion having annular ridge means projecting into said axial bore for resiliently engaging complimentary means of the center contact means when the center contact means is positioned in said axial bore; and said air gap compensating for impedance mismatch caused when outer conductor means and center conductor means of a coaxial cable means are respectively terminated to the shell body and center contact means.

2. A dielectric plug as set forth in claim 1 wherein said outer portion has an external annular flange for abutment with the shell body limiting movement of the dielectric plug thereinto.

3. A dielectric plug as set forth in claim 1 wherein said outer portion and said inner portion are cylindrical.

* * * * *